US007207254B2

(12) United States Patent
Veitch et al.

(10) Patent No.: US 7,207,254 B2
(45) Date of Patent: Apr. 24, 2007

(54) LAUNCHING OF MISSILES

(75) Inventors: Alan J. Veitch, Hertfordshire (GB); Anthony Machell, Hertfordshire (GB); John W. M. Winter, Hertfordshire (GB); Roger T. Harriss, Hertfordshire (GB)

(73) Assignee: MBDA UK Limited, Hertfordshire (GB)

( * ) Notice: Subject to any disclaimer, the term of this patent is extended or adjusted under 35 U.S.C. 154(b) by 833 days.

(21) Appl. No.: 10/106,530

(22) Filed: Mar. 20, 2002

(65) Prior Publication Data

US 2006/0107828 A1 May 25, 2006

(30) Foreign Application Priority Data

Mar. 27, 2001 (GB) ..... 0107552.2

(51) Int. Cl.
*F41F 3/042* (2006.01)
*F41F 3/077* (2006.01)

(52) U.S. Cl. ..... 89/1.818; 89/1.807

(58) Field of Classification Search ..... 89/1.809, 89/1.81, 1.818, 1.807
See application file for complete search history.

(56) References Cited

U.S. PATENT DOCUMENTS

| | | | | |
|---|---|---|---|---|
| 3,106,132 | A * | 10/1963 | Biermann et al. | 89/1.815 |
| 3,779,130 | A * | 12/1973 | Schnabele | 89/1.701 |
| 3,815,469 | A | 6/1974 | Schubert et al. | 89/1.701 |
| 4,671,163 | A | 6/1987 | Erikson | 89/1.818 |
| 4,676,136 | A * | 6/1987 | Kalin | 89/1.701 |
| 4,796,510 | A * | 1/1989 | Piesik | 89/1.816 |
| 5,198,610 | A | 3/1993 | Kennedy et al. | 89/1.812 |
| 5,313,870 | A * | 5/1994 | Clark | 89/1.701 |
| 5,357,841 | A | 10/1994 | Clark et al. | 89/1.701 |
| 5,918,307 | A | 6/1999 | Cipolla | 89/1.81 |
| 6,352,030 | B1 * | 3/2002 | Doll et al. | 102/291 |

FOREIGN PATENT DOCUMENTS

| | | |
|---|---|---|
| DE | 35 03 040 | 7/1986 |
| DE | 39 39 037 A1 | 5/1991 |
| DE | 40 30 712 | 4/1992 |
| EP | 0 054 877 | 6/1982 |
| EP | 0 508 609 | 10/1992 |
| FR | 0 262 037 | 3/1988 |
| GB | 1 206 945 | 9/1970 |
| GB | 1 213 711 | 11/1970 |
| GB | 1 274 632 | 5/1972 |
| GB | 1 364 728 | 8/1974 |
| GB | 1 382 888 | 2/1975 |
| GB | 1 427 182 | 3/1976 |
| GB | 2 186 956 | 8/1987 |
| GB | 2 374 398 | 10/2002 |
| JP | 2000-65496 | 3/2000 |

* cited by examiner

*Primary Examiner*—Stephen M. Johnson
(74) *Attorney, Agent, or Firm*—Nixon & Vanderhye P.C.

(57) ABSTRACT

A missile launcher comprising a canister for housing a missile and piston based launcher, the piston being arrested in the tube after launch of the missile.

10 Claims, 1 Drawing Sheet

LAUNCHING OF MISSILES

Figure 2:
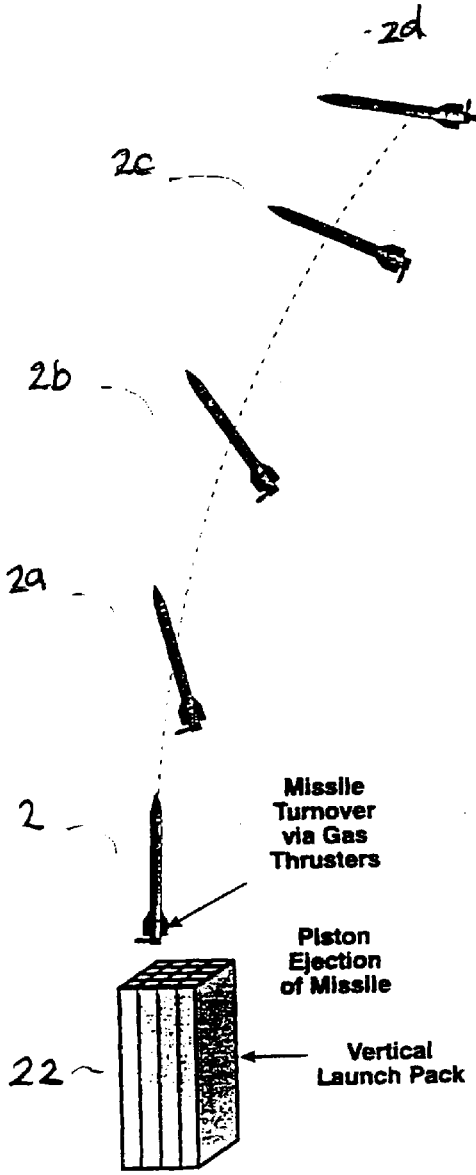

This invention relates to improvements in the method and apparatus used for the launching of missiles and projectiles and more specifically, but not exclusively, to the vertical launching of said missiles and projectiles.

The vertical launch missile concept has been employed by weapon system designers and manufacturers to facilitate the launch of predominantly land based and ship borne missiles. The current state of the art with regards systems and apparatus used for the vertical launch of missiles is generally divided into two categories, namely hard launch and cold launch.

In a hard launch system the missile motor is ignited while the missile is in the launch canister. This approach requires significant efflux management to due to the forces and debris produced as a consequence of allowing the primary the missile launch motor to be ignited within the launch tube. In such a launch system the missile accelerates rapidly and conducts turnover with a high vertical velocity component.

The problems associated with state of the art hard launch systems relate in most part to the effects of the missile efflux on the launch tube and surrounding structure. In terms of launch tube design, in a hard launch system the canister surrounding the missile is designed to safely contain a 'hangfire' situation. In such a situation a missile launch may have been initiated but for some technical reason the missile is unable to leave the canister. The missile motor therefore continues to burn for the duration of its fuel load whilst still in the canister. In order to prevent damage to surrounding structure or indeed adjacent missiles if the missiles are held in a multiple launch system, hard launch canisters are therefore generally of a high strength and corresponding high mass design.

In addition to the mass required due to the strength of the launch structure, hard launched weapons require a boost motor to initiate the launch of the weapon from the canister, thereby adding additional mass and length to the combined launch system and weapon assembly.

Furthermore, in a hard launch system which comprises a multiple canister design, significant additional mass is required to manage the thermal loads generated within each of the individual canisters. Management of these thermal loads is required to ensure no interference is caused between the canisters due to the presence of the numerous missile efflux's which could adversely affect the rapid launch of multiple weapons.

Other disadvantages of hard launch systems include the easy identification of a missile launch position and the generation of efflux and launch debris with the potential for damaging or obscuring sensor windows during the launch phase.

In a cold launch system, the missile rocket motor is ignited only after it has been "pushed" out of its canister and in some instances orientated towards its intended flight path. An example of such a system would be the SA-N-6 that entered the Russian navy in the late 80's on board Kirkov-class and Slava-class cruisers.

Disadvantages associated with cold launch systems include the requirement for the launch tube to contain apparatus required to eject a missile, thereby adding to the mass and complexity of the canister and missile assembly.

The launch tube utilised in state of the art cold launch systems usually employ an explosive charge dedicated to ejecting the missile from the canister, thereby requiring the tube to retain an element of efflux management. Additionally, due to the use of an ejection charge launch debris is still produced which can lead to unwanted subsequent identification of a launch site and the possibility of damage of unwanted interference with missile sensor windows.

The invention described herein provides an alternative to both hard and cold launch systems and offers significant technical improvements in relation to missile launch logistics, weapon system safety and operational effectiveness.

Accordingly there is provided a missile launch apparatus comprising at least one canister, each canister further comprising a tube with an opening for receiving a missile, and each canister further comprising a piston means, said piston means further comprising a propulsion means, each canister additionally comprising a piston arrester means.

In one embodiment, the rocket motor/gas generator (RMGG) completes its burn within the piston stroke and the piston is arrested, allowing the missile to continue on a ballistic trajectory. The piston seals the launch tube reducing launch signature.

In a second embodiment, the piston and RMGG are attached to the missile providing an efficient ejection system but continue to propel the missile over part of its free flight. Gases bled from the RMGG can also be used to power a lateral reaction control system for early missile manoeuvring. On ignition of the missile main motor at the required altitude and attitude, the piston is ejected and falls away.

In a third embodiment, multiple RMGGs are embedded or attached to the piston and can be activated singly or severally to provide tailored launch dynamics.

Additionally there is provided a method of launching a missile comprising the use of missile launch apparatus comprising at least one canister, each canister further comprising a tube with an opening for receiving a missile, and each canister further comprising a piston means, said piston means further comprising a propulsion means, each canister additionally comprising a piston arrester means.

The invention provides a launch method akin to cold launch, in that the missile rocket motor is ignited after it exits the canister. However missile ejection is more precisely controlled such that the missile is subjected to much lower launch loads and requires less energy to complete the launch and turnover sequence. The construction of a more simple and lightweight launch system is therefore possible. The technique also offers the prospect of programmability of missile ejection characteristics.

The missile is ejected from the launch tube by a piston driven by means of hot or cold gas, similar to an ejection seat. The invention uses a novel powered piston approach that allows the missile ejection to be more precisely controlled such that the missile is subjected to much lower launch loads and requires less energy to complete the launch event. The piston is caught and retarded before it leaves the canister thereby avoided unwanted launch debris.

In contrast to more conventional vertical launch systems, the invention provides for the ignition of the rocket motor after the missile has been launched and directed towards the target This feature permits the launch of a missile from a canister in a controlled manner without the problems associated with conventional boost motors or launch motors, including high acceleration, large dispersions, efflux management and disclosure.

It is unique in that the powered piston, which is arrested in the tube on completion of the stroke, is actually part of the missile making the production of the tube free from explosives. Control of the g stroke is possible with this method leading to a very low constant g being seen by the missile throughout the stroke length, and hence the platform, during launch. An additional advancement is that the ejection technique is efficient in that it employs a combination of thrust augmentation and pressure ejection therefore much lower pressures are possible with this technique.

With canister pressures as low as 3 bar, launch times and eject velocities are such that significant improvements to gathering time and minimum range can be achieved over conventional launch techniques. The low pressure also permits the use of lightweight materials and novel shapes for the launch canister The invention offers many significant advantages over conventional vertical launch methods, including a longer maximum range for a given mass when compared with hard vertical launch methods, and no requirement for efflux management requirements due to the containment of the ejection propulsion mechanism within the canister and consequently no unwanted launch debris.

Using a launch system in accordance with the invention there can be no possibility of a missile 'hangfire' situation, and therefore launch systems can therefore be manufactured to a simple, lightweight construction. Such systems will accordingly require reduced maintenance—(i.e. no need for ablative repair) and can be designed as one-shot systems (i.e. throw-away/drop-packs), or as re-usable systems.

Additionally, the invention provides for the possibility of tailored reductions in launch ejection loads (i.e. optimising ejection characteristics for known stores types from a single launcher) and for improved minimum range capability due to a more tailored and direct turnover trajectory that can enable earlier target acquisition by the missile seeker.

Other benefits and improvements made possible by the use of a launch system in accordance with the invention include a reduction in the probability of disclosure of launch position due to reduced smoke trails and launcher heating, the ability to launch a variety of types of missiles and countermeasures (i.e. the canister ejection characteristics be tailored to suit a wide range of products) and the use of the system for adapting existing horizontal launch weapons to vertical launch.

Figure 1:
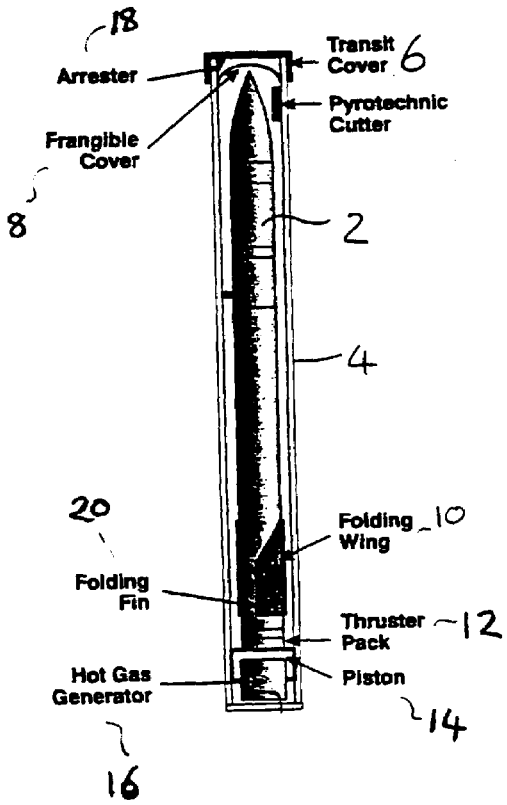

A example of a weapon launch system in accordance with the invention will now be given by way of example only with reference to the accompanying drawings in which;

FIG. 1—shows a missile housed in a launch canister in accordance with the invention; and FIG. 2—shows a diagrammatic representation of the initial trajectory of a missile launched by a system in accordance with the invention.

FIG. 1 shows a missile 2 and thruster pack 12 contained within a canister 4, the tailcone of the missile shown located into a recess in a piston 14. A transit cover 6 is shown protecting the launch tube exit, and a frangible cover 8 is provided such that the missile can be held in a hermetically sealed environment, thereby minimising any possible environmental effects that could adversely affect the reliability of the launch system or missile operation.

The missile 2 is radially and axially supported during transport by virtue of its tailcone location with the piston 14 and at the opposite end of the launch canister by a piston arrester 18. The support offered to the missile 2 helps to ensure that the piston 14 does not twist and jam during the launch phase.

The piston arrester 18 is designed to provide lateral support for the missile, without impeding the passage of the missile fins 20 or wings 10 during launch. The piston arrester 18 functions as a non resilient end stop for the piston 14, absorbing its kinetic energy and allowing the piston 14 to be brought a halt thereby maximising the effective stroke of the piston 14.

A rocket motor/gas generator (RMGG) 16 is embedded within or attached to the piston 14 and provides motive forces by generating both pressure and thrust. This arrangement allows for the controlled burning of propellant, thereby increasing the efficiency of the gases used and minimising any requirement for efflux management.

When the missile fire command is initiated, the RMGG 16 is activated and generates a pre-designated level of thrust, forcing the piston 14 and the missile 2 to be accelerated up the canister tube 4. As the missile is driven up the canister 4 the tip of the missile 2 pierces the frangible cover 8 and guided by the piston arrester 18, the missile exits the launch canister 4.

The piston 14 is driven by the RMGG 16 until it meets the piston arrester 18, at which point the piston 14 is mechanically brought to a halt, thereby sealing the efflux gasses from the RMGG within the body of the launch canister 4. The ejection system is designed to impart the missile with an exit velocity sufficient to allow it to achieve an optimum turnover altitude within a required time whilst containing all ejection effects within the canister.

The sequence shown at FIG. 2 shows a missile 2 leaving a multiple vertical launch pack 22 and being turned 2*a*,2*b*,2*c* towards a target predicted intercept point by means of a solid propellant, rocket powered, thruster 12. The thruster pack 12 provides lateral control in pitch, yaw and roll and once turned, the main missile boost motor is ignited 2*d*. The invention provides for a significantly smoother and more controllable missile turnover, enabling rapid target acquisition by the seeker thereby offering improvements over existing systems in minimum range engagements.

This overall approach eliminates the need for a complex efflux management system enabling a simpler, lightweight launcher to be used. This in turn minimises restriction to launch site or proximity to ground troops providing for deployment in urban areas to be limited only by the requirements of surveillance and alerting devices.

The launch system comprises at least one tube with electrical interfaces for operation and test together with an ejector mechanism. The invention will enable the development of a unified launch system design, utilising selected dimensions that could enable the system to be configured to provide multiple launch containers.

The invention claimed is:

1. A missile launch apparatus comprising:

at least one canister, each canister comprising a tube with an opening for receiving a missile;

a piston means including a piston and a propulsion means for moving the piston along the canister thereby ejecting the missile, wherein the propulsion means is attached to or embedded within the piston means such that the propulsion means remains with the piston means during ejection of the missile from the canister; and a thruster pack for bleeding gases from said propulsion means and for providing initial lateral control of said missile.

2. A missile launch apparatus as claimed in claim 1, wherein the piston means is provided with a plurality of propulsion means, each of said propulsion means being capable of being activated singly or severally.

3. A missile launch apparatus as claimed in claim 1, wherein the piston means is detachably attached to the missile.

4. A missile launch apparatus as claimed in claim 1, wherein the canister is of substantially square cross-section.

5. A missile launch apparatus as claimed in claim 1, wherein the piston means is ejected on ignition of the missile main motor.

6. A method of launching a missile, comprising the steps of:

loading a launch tube a missile, said launch tube including an opening for receiving said missile, ejecting the missile from the launch tube using a piston and a propulsion means for moving the piston along the launch tube, wherein the propulsion means is attached to or embedded within the piston such that the propulsion means travels with the piston during ejection of the missile from the launch tube; and bleeding gases from said propulsion means to power a thruster pack for providing initial lateral control of said missile.

7. A method of launching a missile as claimed in claim 6, wherein the piston is provided with a plurality of propulsion means, each of the propulsion means being capable of being activated singly or severally.

8. A method of launching a missile as claimed in claim 6, wherein the missile is detachably attached to the piston prior to the missile being loaded.

9. A method of launching a missile as claimed in claim 6, wherein said loading step includes loading a launch tube having a substantially square cross-section.

10. A method of launching a missile as claimed in claim 6 including the steps of igniting a main motor of said missile and ejecting said piston from said missile.

* * * * *